US005674330A

United States Patent [19]

Charquet et al.

[11] Patent Number: 5,674,330

[45] Date of Patent: Oct. 7, 1997

[54] PROCESS FOR THE PRODUCTION OF ZIRCONIUM ALLOY SHEET METAL HAVING GOOD RESISTANCE TO NODULAR CORROSION AND TO DEFORMATION UNDER IRRADIATION

[75] Inventors: Daniel Charquet, Albertville; Pierre Barberis, Ugine; Gérard Bunel, Echauffour, all of France

[73] Assignee: Compagnie Europeene du Zirconium Cezus, Courbevoie, France

[21] Appl. No.: 515,013

[22] Filed: Aug. 14, 1995

[30] Foreign Application Priority Data

Aug. 30, 1994 [FR] France ..... 94 10592

[51] Int. Cl.[6] ..... C22F 1/18

[52] U.S. Cl. ..... 148/672; 148/421

[58] Field of Search ..... 148/672, 671, 148/670, 421, 538; 376/212, 213; 976/DIG. 247

[56] References Cited

U.S. PATENT DOCUMENTS

| | | | |
|---|---|---|---|
| 2,894,866 | 7/1959 | Picklesimer | 148/672 |
| 4,450,020 | 5/1984 | Vesterlund | 148/672 |
| 4,521,259 | 6/1985 | Euken | 148/672 |
| 4,678,521 | 7/1987 | Yoshida et al. | 148/672 |
| 5,194,101 | 3/1993 | Worcester et al. | 148/421 |
| 5,256,621 | 10/1993 | Bunel et al. | 148/672 |
| 5,417,779 | 5/1995 | Griebel et al. | 148/670 |

FOREIGN PATENT DOCUMENTS

| | | | |
|---|---|---|---|
| 705863 | 3/1965 | Canada | 148/672 |
| 85553 | 8/1983 | European Pat. Off. | 148/672 |
| 59-226158 | 12/1984 | Japan | 148/672 |

*Primary Examiner*—David A. Simmons
*Assistant Examiner*—Margery S. Phipps
*Attorney, Agent, or Firm*—Dennison, Meserole, Pollack & Scheiner

[57] ABSTRACT

A process for the fabrication of zirconium alloy sheet specifically intended for the manufacture of structural elements for boiling water reactors, which includes the following steps:

a) producing in a vacuum an ingot having the composition of the desired alloy;

b) forging and hot rolling the ingot;

c) quenching of the blank thus obtained after reheating in the beta range;

d) hot rolling after heating;

e) heat treatment in the alpha range;

f) at least one cycle of cold rolling followed by a heat treating in the alpha range; and g) final cold rolling followed by subcritical annealing in the alpha range;

where the hot rolling of the sheet after quenching from the beta range is carried out in an initial direction, then in a direction perpendicular to the initial direction.

16 Claims, 2 Drawing Sheets

PROCESS FOR THE PRODUCTION OF ZIRCONIUM ALLOY SHEET METAL HAVING GOOD RESISTANCE TO NODULAR CORROSION AND TO DEFORMATION UNDER IRRADIATION

BACKGROUND OF THE INVENTION

The present invention relates to a process for the production of a sheet of zirconium alloy which contains additions, by weight, of 0.5 to 2% tin, 0 to 0.1% nickel, 0.1 to 0.4% iron, 0.05 to 0.2% chromium, with a possible supplementary addition of niobium or vanadium.

These zirconium alloys, which include the alloys Zircaloy 2 and Zircaloy 4 whose exact compositions are respectively those of R60802 and R60804 in the specifications of ASTM B 352-85, are specifically used for the production of fuel element casings for boiling water nuclear reactors (BWR). These casings, produced by forming sheets of these zirconium alloys whose thickness can vary from 0.8 to 3.5 mm, contain the nuclear assembly bundles. For these structural applications in boiling water reactors, the zirconium alloy sheets obviously must have good formability during their utilization and also good resistance to nodular corrosion and to deformation under irradiation.

It is well known that in order to guarantee good resistance to nodular corrosion, zirconium alloy sheets must have an adequate metallurgical structure which generally includes fine intermetallic precipitates, either distributed uniformly or at the grain boundaries. Various sheet metal working processes have been proposed in order to obtain these metallurgical structures with the desired distribution of precipitates:

a) The processes which stimulate the development of homogeneous structures of the alpha type which include fine precipitates uniformly distributed in the grains, by carrying out, after an intermediate quenching from the beta range, mechanical heat treatments in alpha with limited durations and temperatures, such as those of FR-A-2672057 or EP-A-0446924 (=U.S. Pat. Nos. 5,194,101 and 5,242,515).

b) The processes which favor the development of heterogeneous structures of the (alpha+beta) type, even the beta type, by carrying out, after rapid heating of the sheet (FR-2303865B=GB-A-1537930) or of the already formed casing (FR-2302569B=U.S. Pat. No. 4,238,251) in the (alpha+beta) range, even in the beta range, a rapid cooling to the alpha range, possibly followed by heat treatments in the alpha range.

These processes intended to improve the nodular corrosion resistance of zirconium alloys, particularly Zircaloy 2 and Zircaloy 4, do not make it possible to obtain a satisfactory compromise between the different working properties of the material. Thus the homogeneous structures, due to their crystallographic texture, lead to excessive growths under irradiation; conversely, the heterogeneous structures are characterized by insufficient formability (by stamping or bending), while their crystallographic texture stimulates low growth under irradiation.

This crystallographic texture for zirconium and its alloys is commonly characterized by 3 factors, determined with X-rays by means of a pole figure, which define the degree of anisotropy of the zirconium alloy sheet. These factors, known as Kearns factors, are measured in 3 perpendicular directions and are respectively marked:

fDL in the rolling direction, fDT in the transverse direction, fDN in the direction normal to the plane of the sheet, and they conform to the relationship fDL+fDT+fDN=1.

It is known on one hand that growth under irradiation is proportional to the quantity (1–3 fDL), and on the other hand that corrosion is not uniform according to the orientation of the surface grains of the finished sheet, and in particular that the base poles (0002) parallel to the normal direction lead to better corrosion resistance than the poles inclined approximately 30° in the transverse direction typically obtained with the processes of the prior art.

These observations were published in the article by D. Charquet, R. Tricot, and J. F. Wadier: "Heterogeneous scale growth during steam corrosion of Zircaloy 4 at 500° C.," Eighth Symposium ASTM STP 1023, American Society for Testing and Materials, Philadelphia, 1989, pages 374 through 391.

In order to improve resistance to nodular corrosion, it is therefore advantageous to seek the highest fDN factor possible, while limiting the fDT factor in the transverse direction. This is achieved in FR-A-2673198=U.S. Pat. No. 5,256,216 for the fabrication of long-length strips or sheets of Zircaloy 2 or Zircaloy 4 which have both good resistance to nodular corrosion and low growth under irradiation, due to the combined effects of a structure with fine second phase precipitates distributed between the beta to alpha transformation acicular and with an isotropic texture, since the Kearns factors are respectively:

fDN=0.35 to 0.45 fDT=0.25 to 0.35 fDL=0.20 to 0.30 where by definition fDN+fDT+fDL=1, whereas sheets with an alpha type or (alpha+beta) type structure classically have a marked crosswise trend in the orientation of the base planes (0002) with the typical Kearns factors:

fDN=0.55 to 0.60 fDT=0.30 to 0.35 fDL=0.09 to 0.11.

In order to do this, the process according to FR-A-2673198 includes operations for heat treatment in the beta range of the strip or sheet to 1000° C., maintained for 1 or 2 minutes between 1000° and 1100° C. before rapid cooling (>40° C./second) to between 1000° C. and 600° C. These operations are carried out by means of the passage of the strip or sheet at a constant speed while it is heated by Joule effect between at least two pairs of rollers, which act as an electrical connection, while assuring the gage, indeed the rolling, of the strip or sheet before an abrupt cooling by spraying a jet of liquified neutral gas on its upper and lower surfaces simultaneously.

The heating by Joule effect thus carried out between pairs of rollers, unlike heating by induction, allows homogeneous heating throughout the volume of the strip or sheet in question, and it proves to be critical for obtaining a homogeneous microstructure and an isotropic crystallographic texture which is concretely expressed by three closely related Kearns factors fDL, fDN, and fDT.

While this process effectively makes it possible to obtain strips or sheets of long length which greatly resist nodular corrosion (weight gain less than 60 mg/dm$^2$ in a 24-hour corrosion test at 500° C. in pressurized water vapor) and deformation under irradiation (fDL being considerably improved), it has 2 disadvantages:

The first is of an economic nature, since the principle of this process (passage of the sheet between rollers at a constant speed, the sheet being subjected to a sequential treatment with reheating, temperature maintenance, then abrupt cooling or quenching) can only be applied to strips or sheets of long length (L>100 m) and of reduced width (generally w<300 m). In addition to numerous systematic drops in production during changes in the Zr alloy composition or in the adjustment of the thickness of the sheet in the course of operation, this process necessitates specific, costly investments for its implementation, which ultimately limit its advantages and therefore its application to large units of production.

The second is of a qualitative nature. In effect, like all the processes of the prior art which recommend a reheating in the beta range followed by a quenching to the alpha range, this process favors the appearance of an acicular microstructure which is not very conducive to the formability of the sheet. This can prove to be unsuitable for the production of certain structural elements by means of deep drawing.

Production "on demand," and at non-prohibitive costs, of zirconium alloy sheets of short length (L≈4 meters) but of sufficient width (w≈0.60 meters), having good resistance to nodular corrosion and to deformation under irradiation while conserving good formability, remains an unresolved problem for one skilled in the art.

SUMMARY OF THE INVENTION

It is therefore the object of the invention to solve this problem based on the following double determination:

1) It is possible, during the hot rolling of the zirconium alloy after quenching, to modify the crystallographic texture of the sheet while simultaneously improving the longitudinal Kearns factor fDL and the normal factor fDN and, consequently, the sheet's resistance to deformation under irradiation and to nodular corrosion.
2) It is also possible to preserve this texture of the sheet obtained by hot rolling until the final dimensions are obtained, while developing a metallurgical structure of equiaxed (and non-acicular) grain with a dense, homogeneous distribution of fine intermetallic precipitates.

More precisely, the invention relates to a process for the production of zirconium alloy sheet metal with a thickness between 0.8 and 3.5 mm, specifically intended for the making of structural elements in boiling water reactors, which includes the following steps:

a) production in a vacuum of an ingot with the composition, by weight, of 0.1 to 0.4% iron, 0.5 to 2% tin, 0 to 0.1% nickel, and 0.05 to 0.2% chromium, with a possible supplementary addition of niobium or vanadium, the balance being constituted by zirconium and the inevitable impurities,
b) forging of the ingot at a temperature higher than 700° C. and hot rolling at a temperature higher than 900° C.,
c) quenching of the blank thus obtained after reheating in the beta range,
d) hot rolling after heating between 500° and 700° C.,
e) heat treatment in the alpha range,
f) at least one cold rolling followed by a heat treatment in the alpha range,
g) final cold rolling followed by a subcritical annealing in the alpha range, characterized in that the hot rolling of the sheet after quenching from the beta range is carried out first in one direction, then in a direction perpendicular to the initial rolling direction.

During this crosswise rolling, the proportion of deformation of the sheet, defined by the relation 100(1-e/E), in which E and e respectively represent the initial and final thicknesses of the sheet expressed in mm, is generally between 30 and 40% during the first rolling and between 30 and 70% during the rolling in the direction perpendicular to the initial direction.

With the exception of the process according to FR-A-2673198=U.S. Pat. No. 5,256,216, which is reserved for the production of a zirconium alloy sheet of long length and difficult to apply to the present case for the reasons mentioned previously, the processes which develop a structure of the alpha type or the (alpha+beta) type favor the formation during the hot rolling of a texture with crystallographic orientation called T, which is similar to that of pure zirconium and according to which the base sheets (0002) are typically disoriented about 30° (20° to 40°) in the transverse direction.

This texture, which translates into an increase in the transverse factor fDT to the detriment of the longitudinal fDL and normal fDN factors in the Kearns relation fDT+fDL+fDN=1 at the end of the hot rolling operations, is then difficult to correct during the annealing and cold rolling operations which are primarily intended to regulate the final microstructure and thickness of the sheet.

During testing, the Applicants have been able to determine that by carrying out a crosswise hot rolling of the sheet in two perpendicular directions, it is possible to significantly reduce this marked crosswise trend in the orientation of the base planes (0002), with the double consequence of an improvement of the fDN and fDL factors, which are critical to good resistance to nodular corrosion and to growth under irradiation for the sheet.

Furthermore, thanks to cycles of limited cold-working (deformation proportion≧60%) and total or partial recrystallization, it is possible to preserve this "cross-rolled" texture of the sheet all the way to its final thickness, while favoring the development of a metallurgical microstructure of equiaxed grains with fine second phase intermetallic precipitates which are uniformly distributed, a condition which is also essential to assure excellent nodular corrosion resistance as well as good formability of the sheet.

BRIEF DESCRIPTION OF THE DRAWINGS

The invention will be better understood with reference to the drawings, in which.

DESCRIPTION OF THE PREFERRED EMBODIMENTS

Figure 1:
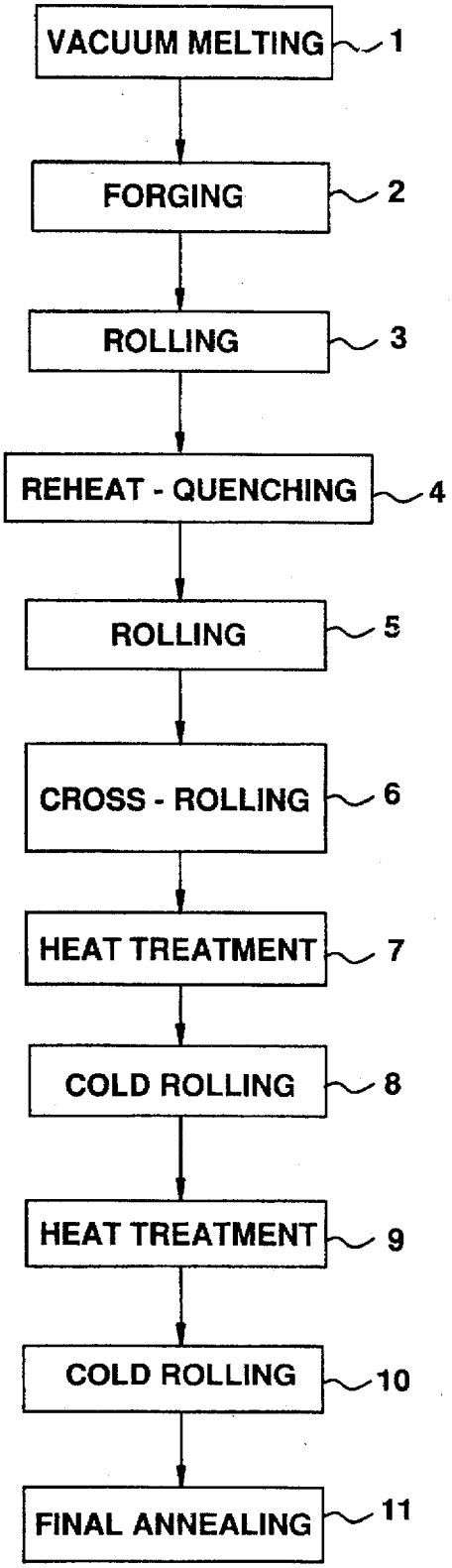
FIG. 1 is a flow chart of the process of the invention.
Figure 2A:
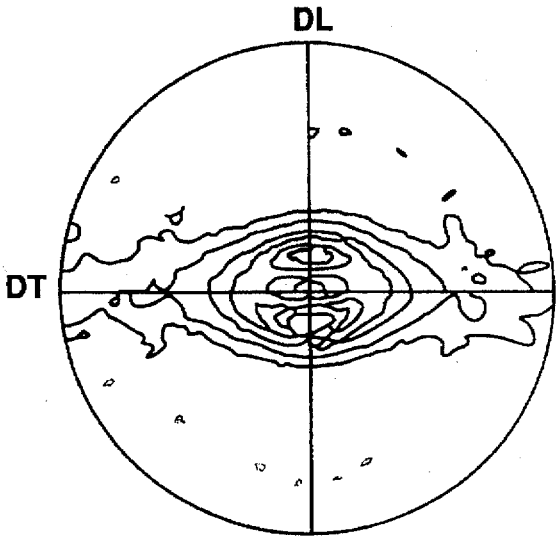
FIGS. 2A, 2B, 2C, and 2D are pole figures (0002) of X-ray diffraction, respectively, of a sheet of Zircaloy 4 which is 3 mm thick after crossed hot rolling (FIG. 2A), after unidirectional hot rolling (FIG. 2B), after cold rolling and recrystallization of the cross-rolled sheet (FIG. 2C) and of a unidirectionally rolled sheet (FIG. 2D).
Figure 2B:
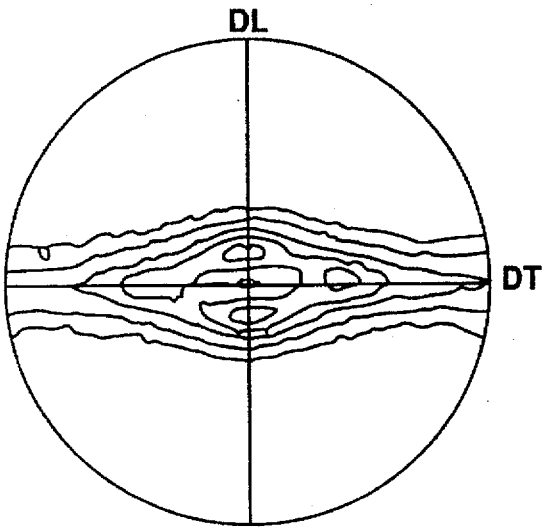
Figure 2C:
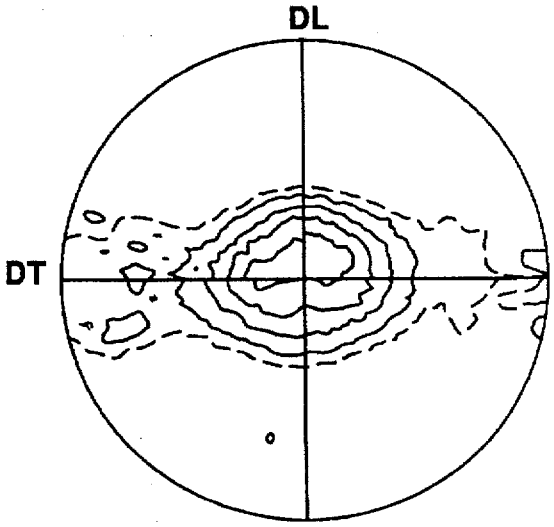
Figure 2D:
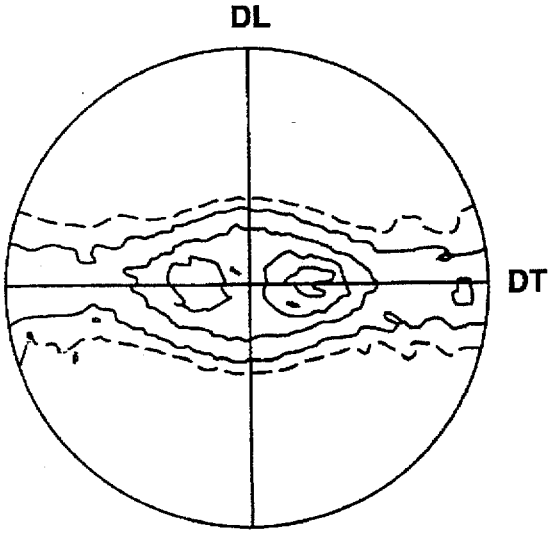

Thus, as shown in FIG. 1, zirconium alloy ingots having a composition by weight of 0.1 to 0.4% Fe, 0.5 to 2% Sn, 0 to 0.1% Ni, 0.05 to 0.2% Cr, balance Zr+impurities, obtained by vacuum melting 1, are forged 2 between 700° and 1100° C. into blanks on the order of 100 mm thick, which are then hot rolled 3 between 930° and 970° C. to about a thickness of 40 mm. After reheating between 1000° and 1040° C., the blanks thus obtained are quenched with water 4. At this stage of working, the quenching texture is characterized by its isotropy (fDL≈fDN≈fDT≈0.33).

Next, the first phase of hot rolling 5 of the blank in the long direction is carried out, after heating preferably between 630° and 670° C., to a thickness of 25 mm (namely a deformation proportion of 37%) which leads to a standard crosswise texture. Then, the rolling direction is crossed 6 in a perpendicular direction, also after heating between 630° and 670° C., until a thickness of 8 mm is obtained (namely a deformation proportion of about 68%). Thus the poles are reoriented in the new transverse direction, in such a way that fDN and also, surprisingly, fDL increase to the detriment of fDT.

The hot rolled product is then transformed into its final sheet size with a thickness between 0.8 and 3.5 mm in at least 2 moderate cold working-recrystallization cycles, that is, with a deformation proportion upon rolling which does not exceed 60% and is preferably between 30 and 45% in each cycle.

Thus, after a first heat treatment 7 between 520° and 670° C. for 1 to 3 hours in a batch-type furnace or between 650° and 750° C. for 1 to 10 minutes in a continuous furnace, which preferably can be a subcritical annealing carried out in a batch-type furnace for 1 to 3 hours between 620° and 670° C. or in a continuous furnace for 1 to 10 minutes between 700° and 750° C., a first cold rolling 8 is carried out in order to reduce the thickness of the sheet to about 5 mm (namely a deformation proportion on the order of 37%).

After an intermediate heat treatment 9 analogous to the first heat treatment 7, which can be a subcritical annealing, a second cold rolling 10 of the sheet is carried out to a thickness of 3.2 mm (namely a deformation proportion of 36%). The final heat treatment 11 of the sheet consists of a final subcritical annealing between 620° and 670° C. for 1 to 3 hours in a batch-type furnace or between 700° and 750° C. for 1 to 10 minutes in a continuous furnace. By complying with these conditions for cold-working and heat treatment, the "cross- rolled" texture of the hot rolling is preserved without interfering, from the standpoint of the metallurgical structure, with the formation of a homogeneous lattice of precipitated intermetallic fines in a structure of equiaxed grains.

The following two examples relate to the application of the process to the production of sheets of Zircaloy 2 and Zircaloy 4.

EXAMPLE 1

Production of a Sheet of Zircaloy 2 with a Thickness of 3.2 mm for Fuel Element Casings Composition by weight: 1.3% Sn, 0.06% Ni, 0.18% Fe, 0.10% Cr, the balance Zr and inevitable impurities.

Production sequence according to the preceding description, more precisely:

- temperature for hot rolling to a thickness of 40 mm: 950° C.;
- quenching with water from beta;
- after quenching, first hot rolling phase in the long direction to a thickness of 25 mm after heating to a temperature of 650° C.;
- second, crossed hot rolling phase to a thickness of 8 mm after heating to a temperature of 650° C.;
- heat treatment at 620° C. for 2 hours in a batch-type furnace;
- cold rolling to a thickness of 5 mm;
- intermediate heat treatment to 650° C. for 1 hour in a batch-type furnace;
- cold rolling to a thickness of 3.2 mm;
- final subcritical annealing in a continuous furnace at 700° C. for 10 minutes.

In Table 1 below, the Kearns factors obtained from the pole figures 0002 measured on 5 samples of the Zircaloy 2 sheet thus prepared are compared to the Kearns factors obtained on 5 samples of a Zircaloy 2 sheet prepared according to the prior art, by unidirectional rolling exclusively. The Kearns factors obtained after hot rolling of the sheet (L.A.C.) and after final treatment have also been indicated.

Also indicated in Table 1 are the results of the comparative tests of resistance to nodular corrosion by water vapor for 24 hours at 500° C. in an autoclave, as well as the values of the coefficients (1–3 fDL) of susceptibility to growth under irradiation, of the Zircaloy 2 sheets prepared according to the invention and according to the prior art.

TABLE 1

| | | Zircaloy 2 t = 3.2 mm PRIOR ART | Zircaloy 2 t = 3.2 mm ACCORDING TO INVENTION |
|---|---|---|---|
| fDL | HR* | 0.09 to 0.11 | 0.13 to 0.14 |
| | Final state | 0.09 to 0.11 | 0.13 to 0.14 |
| fDN | HR | 0.55 to 0.60 | 0.60 to 0.65 |
| | Final state | 0.55 to 0.60 | 0.60 to 0.65 |
| fDT | HR | 0.30 to 0.35 | 0.20 to 0.25 |
| | Final state | 0.30 to 0.35 | 0.20 to 0.25 |
| (1-3fDL) Final state | | 0.67 to 0.73 | 0.58 to 0.61 |
| Corrosion test 500° C./24 hr Weight gain mg/dm$^2$ | | 60 | 50 |

*Hot rolling

It is well confirmed that whatever the hot rolling mode, the texture characteristics fDL, fDN, fDT obtained at the end of hot rolling are preserved in the final state if the process is continued in accordance with the moderate cold working-recrystallization cycles.

It is noted that in the cross-rolled sheets according to the invention, there is a significant improvement in the Kearns factors fDL and fDN and, in compensation, a reduction in the transversal factor fDT, which translates in practice into both a reduction of more than 10% in the factor of susceptibility to growth under irradiation (1–3 fDL) and into better resistance to nodular corrosion, while preserving an excellent bending capability.

EXAMPLE 2

Production of a Sheet of Zircaloy 4 with a Thickness of 1.5 mm

Percent composition: 1.3% Sn, 0.22% Fe, 0.12% Cr, the balance Zr and impurities.

Production sequence for this sheet of Zircaloy 4:

- temperature for hot rolling to a thickness of 20 mm: 950° C.;
- quenching with water from beta;
- after quenching, first hot rolling phase in the long direction to a thickness of 12 mm at a temperature of 620° C. (40%);
- second, crossed hot rolling phase to a thickness of 6.5 mm (46%) at a temperature of 620° C.;
- heat treatment 1 hour at 620° C.;
- cold rolling to 3 mm (54%);
- intermediate heat treatment 3 hours at 650° C.;
- final cold rolling to 1.5 mm (50%);
- subcritical annealing 3 hours at 650° C.

In Table 2 below, the Kearns factors measured on a sample of a Zircaloy 4 sheet thus prepared are compared, after hot rolling and after final treatment, to the Kearns factors obtained on a sample of a Zircaloy 4 sheet prepared according to the prior art, by unidirectional rolling exclusively.

Also indicated in Table 2 are the comparative results of the tests of nodular corrosion resistance, as well as the values of the coefficients of susceptibility (1–3 fDL) to growth under irradiation.

TABLE 2

| | | Zircaloy 4 t = 1.5 mm PRIOR ART | Zircaloy 4 t = 1.5 mm ACCORDING TO INVENTION |
|---|---|---|---|
| fDL | HR* | 0.10 | 0.13 |
| | Final state | 0.11 | 0.13 |
| fDN | HR | 0.59 | 0.65 |
| | Final state | 0.59 | 0.65 |
| fDT | HR | 0.31 | 0.22 |
| | Final state | 0.30 | 0.22 |
| (1-3fDL) Final state | | 0.67 | 0.61 |
| Corrosion test 500° C./24 hr Weight gain mg/dm$^2$ | | 100 | 70 |

*Hot rolling

The findings are the same as for Zircaloy 2, namely that the texture characteristics are preserved in the final state when the process continues with moderate cycles of cold-working and recrystallization. It will be noted that the texture characteristics verified in a sample of Zircaloy 4 are all within the ranges of the corresponding characteristics obtained with the sheet of Zircaloy 2.

Thus, the process of the invention makes it possible to simultaneously improve the characteristics of resistance to nodular corrosion and to deformation under irradiation while preserving, even improving, the formability of zirconium alloy sheets. Further, the process is simple and economical to implement, since it has no complex supplementary operations and consequently requires no specific costly investment.

What is claimed is:

1. In a process for the production of zirconium alloy sheet with a thickness between 0.8 and 3.5 mm, comprising the sequence of steps:

a) producing under vacuum an ingot having a composition by weight of 0.1 to 0.4% iron, 0.5 to 2% tin, 0 to 0.1% nickel, 0.05 to 0.2% chromium, optionally niobium or vanadium, and the balance zirconium and impurities;

b) forging the ingot at a temperature higher than 700° C. and hot rolling at a temperature higher than 900° C., to form a blank;

c) reheating the blank in the beta range and subsequently quenching to form a quenched blank;

d) hot rolling the quenched blank while maintaining a temperature between 500° and 700° C., to form a hot rolled blank;

e) heat treating the hot rolled blank in the alpha range to form a heat treated blank;

f) at least one intermediate cycle of cold rolling the heat treated blank, followed by heat treating in the alpha range; and subsequently g) final cold rolling of the blank after said heat treating in the alpha range, followed by subcritical annealing in the alpha range;

the improvement comprising carrying out the hot rolling of the quenched blank in an initial rolling direction of deformation in a proportion of between 30 and 40%, then in a direction perpendicular to the initial rolling direction in a proportion of between 30 and 70%.

2. The process according to claim 1, wherein the rolling of the hot ingot after forging of step b) is carried out at a temperature between 930° and 970° C.

3. The process according to claim 1, wherein the reheating of the blank in the beta range is carried out between 1000° and 1040° C.

4. The process according to claim 1, wherein the hot rolling after quenching of the quenched blank is carried out at a temperature between 630° and 670° C.

5. The process according to claim 1, wherein the heat treating the hot rolled blank is carried out in a batch-type furnace for 1 to 3 hours between 520° and 670° C.

6. The process according to claim 5, wherein the heat treating the hot rolled blank is a subcritical annealing carried out in a batch-type furnace for 1 to 3 hours between 620° and 670° C.

7. The process according to claim 1, wherein the heat treating the hot rolled blank is carried out in a continuous furnace between 650° and 750° C. for 1 to 10 minutes.

8. The process according to claim 7, wherein the heat treating the hot rolled blank is a subcritical annealing carried out for 1 to 10 minutes.

9. The process according to claim 1, wherein the deformation proportion in each said cold working cycle does not exceed 60%.

10. The process according to claim 9, wherein said deformation proportion is between 30 and 45%.

11. The process according to claim 1, wherein the heat treating after each said intermediate cold rolling cycle is carried out in a batch-type furnace between 520° and 670° C. for 1 to 3 hours.

12. The process according to claim 11, wherein the heat treating after each said intermediate cold rolling cycle is a subcritical annealing carried out in a batch-type furnace for 1 to 3 hours between 620° and 670° C.

13. The process according to claim 1, wherein the heat treating after each said intermediate cold rolling cycle is carried out in a continuous furnace at between 650° and 750° C. for 1 to 10 minutes.

14. The process according to claim 13, wherein the heat treating after each said intermediate cold rolling cycle is a subcritical annealing carried out in a continuous furnace at between 700° and 750° C. for 1 to 10 minutes.

15. The process according to claim 1, wherein the subcritical annealing after said final cold rolling is carried out in a batch-type furnace for 1 to 3 hours at between 620° and 670° C.

16. The process according to claim 1, wherein the subcritical annealing after said final cold rolling is carried out in a continuous furnace at between 700° and 750° C. for 1 to 10 minutes.

* * * * *